US008434890B2

(12) United States Patent
Baillie

(10) Patent No.: US 8,434,890 B2
(45) Date of Patent: May 7, 2013

(54) ELECTRONIC APPARATUS AND BADGE PANEL FOR USE THEREIN

(75) Inventor: Aileen Baillie, East Killbride (GB)

(73) Assignee: Worldmark International Limited, East Kilbride (GB)

( * ) Notice: Subject to any disclaimer, the term of this patent is extended or adjusted under 35 U.S.C. 154(b) by 679 days.

(21) Appl. No.: 11/629,862

(22) PCT Filed: Jun. 16, 2005

(86) PCT No.: PCT/GB2005/002369

§ 371 (c)(1),
(2), (4) Date: Sep. 26, 2008

(87) PCT Pub. No.: WO2005/124726

PCT Pub. Date: Dec. 29, 2005

(65) Prior Publication Data

US 2009/0052180 A1 Feb. 26, 2009

Related U.S. Application Data

(60) Provisional application No. 60/607,167, filed on Sep. 3, 2004.

(30) Foreign Application Priority Data

Jun. 16, 2004 (GB) ..... 0413429.2

(51) Int. Cl.
*F21V 33/00* (2006.01)

(52) U.S. Cl.
USPC ..... 362/155; 362/97.2; 362/603

(58) Field of Classification Search ..... 362/97.1–97.3, 362/155, 249.01–249.02, 603; 361/679.02, 361/679.21, 679.26–679.28
See application file for complete search history.

(56) References Cited

U.S. PATENT DOCUMENTS

| | | | | |
|---|---|---|---|---|
| 3,997,991 | A | 12/1976 | Hayman-Chaffey et al. | |
| 5,077,551 | A * | 12/1991 | Saitou | 345/207 |
| 5,962,109 | A | 10/1999 | Schwietz et al. | |
| 6,158,156 | A | 12/2000 | Patrick et al. | |
| 6,494,593 | B2 * | 12/2002 | An et al. | 362/235 |
| 2002/0190968 | A1 | 12/2002 | Barnes et al. | |

* cited by examiner

*Primary Examiner* — Jason Moon Han
(74) *Attorney, Agent, or Firm* — Drinker, Biddle & Reath, LLP

(57) ABSTRACT

An electronic apparatus such as a notebook PC or mobile telephone is provided with a badge comprising a multi-layer panel and a light source mounted within the body to illuminate the badge panel from behind. A control circuit senses the orientation of the part of the casing body controls the light source so as to activate it when body part is in a predetermined range of orientations. The multi-layer panel is designed to present a logo in a first orientation (relative to said body part) when illuminated by ambient light and in a second orientation when illuminated from behind by light source. By this means, the orientation of the graphic elements as viewed by an observer can be correct more of the time than by a conventional badge.

11 Claims, 3 Drawing Sheets

ELECTRONIC APPARATUS AND BADGE PANEL FOR USE THEREIN

The invention relates to the provision of badges, for branding or the like of electronic apparatus. The invention finds application in particularly in the badging of portable electronic apparatus, where the orientation of the apparatus and hence the badge varies.

Portable electronic apparatus such as mobile computers (PCs), mobile telephones and so forth generally carry some badge or printed information on their casing to identify the brand of the supplier. The aesthetic design of such items, as distinct from their functionality or price, is increasingly a factor in purchasing decisions of buyers, as these items become commodity items. Suppliers are keen to use their products as a platform for promoting their brand, so a prominent and attractive badge is often desirable.

Portable equipment, by its nature, can be carried or used in a variety of orientations, whereas a typical badge only conveys the correct image if viewed in the correct orientation. For example, a "W" logo will be seen by observers as an "M" when viewed upside down. A badge on the lid of a "flip" type product such as a notebook PC or mobile phone will generally be upside down when the product is opened for use, if it is the correct way up when the product is folded shut.

The invention aims to provide a badge for portable electronic apparatus that will adapt its content to the state of the apparatus. One aim is to provide a badge that will present graphic elements in an orientation which, without moving parts, adapts itself to a current orientation of the apparatus.

The invention provides an electronic apparatus having a body and being provided on the outside of a part of said body with a badge comprising a multi-layer panel and a light source mounted within said body part to illuminate the badge panel from behind, wherein the badge panel is constructed and mounted so as to present a first predetermined graphic pattern when said light source is not activated and to present a second predetermined graphic pattern when the light source is activated, the apparatus further comprising means for sensing the orientation of the part of the body and means for controlling the light source so as to activate it when said body part is in a predetermined range of orientations.

The first and second graphic patterns may comprise substantially the same graphic pattern in a first orientation (relative to said body part) and in a second orientation respectively. By presenting graphic elements in a different orientation relative to the apparatus body part when that body part is itself in a different orientation, the orientation of the graphic elements as viewed by an observer can be correct more of the time. By "substantially the same" It will be understood that the shapes forming the graphic pattern can be recognisably the same, conveying effectively the same information content, while the colour and texture combinations which define the shapes will usually be different in the different modes.

The apparatus body may be articulated such that the orientation of the part provided with the badge can be changed relative to the orientation of another part of the apparatus body.

The body part provide with the badge may be a lid of the apparatus coupled by a pivoting joint to a larger body part. The lid may carry a display panel on an inner face. This type of embodiment will be suitable for notebook type computers, and PDAs and mobile telephone handsets of the "flip" type.

Where the body part provided with the badge is a lid, the lid may be arranged in normal use to open by pivoting upward about a transverse axis and to stand substantially upright in an open state of use, the control means and badge panel may be constructed and oriented such that the graphic pattern is oriented correctly for viewing by a user prior to opening the lid, and, by activating the light source when the lid is opened, is oriented correctly for an observer other than the user in the open mode.

Where the body is articulated, the orientation sensing means may be arranged to sense the orientation of the part carrying the badge only relative to another part of the body.

Alternatively, whether the body is in one part or articulated, the sensing means may sense orientation by reference to the force of gravity.

The presentation of the first graphic pattern when the light source is not activated may rely on ambient light. It would in principle to have another light source activated, for example one of a different hue and/or polarisation, but it is preferable for the badge arrangement not to consume power in one of its states.

In order for the first graphic pattern to be visible under ambient light while allowing the second graphic pattern to be seen clearly through it when illuminated by the light source, the first graphic pattern may be defined by a layer of special effect pigment which modifies light by interference effects.

A display panel exploiting such pigments to display different messages at different times is described in U.S. Pat. No. 6,156,156 (Patrick/John McGavigan Limited). U.S. Pat. No. 5,962,109 (Schweitz/3M) describes a sign using various layers of film and backlighting to change the displayed image. The techniques described in these documents may be applies to create the multi-layer panel of the present invention, couple of course with appropriate selection of the patterns and control of the backlighting.

In order for the first graphic pattern to be visible under ambient light while the second graphic pattern is hidden until the light source is activated, a masking layer having a tint may be provided in said panel between a first graphic layer which defines the first graphic pattern and a second graphic layer which defines the second graphic pattern.

The multi-layer panel may comprise a first graphic layer which defines the first graphic pattern and a second graphic layer which defines the second graphic pattern in its second orientation, each formed by screen printing different inks, and both carried on a transparent substrate.

The first and second graphic layers may be provided on the same side of the substrate, especially the side which is away from the viewer, or on different sides of the substrate. In the latter case, a masking tint may be incorporated in the material of the substrate itself, in order for the first graphic pattern to be visible under ambient light while the its second graphic pattern is hidden until the light source is activated.

The invention in a related aspect provides a badge comprising a multi-layer panel having an obverse side and a reverse side and constructed so as to present a predetermined graphic pattern in a first orientation when viewed from the obverse side and not illuminated from a reverse side and to present substantially the same graphic pattern in a second orientation when illuminated from the reverse side by a suitable light source, the panel thereby being suitable for use as the badge panel of an apparatus according to the invention as set forth above.

The above and other aspects of the invention will be understood more fully from a consideration of the description of exemplary embodiments which follows.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
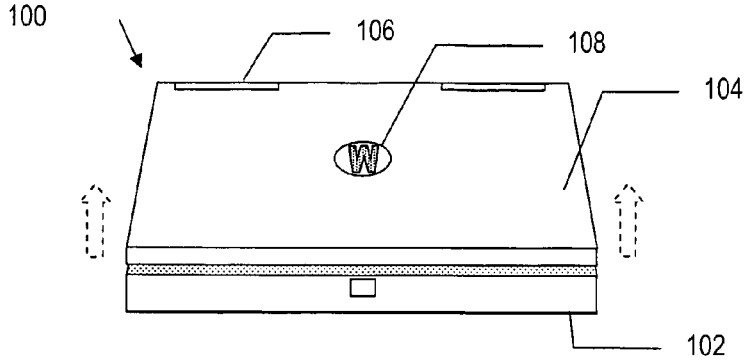
FIG. 1 shows an apparatus embodying the invention in a closed state.

FIG. 1 illustrates a familiar type of electronic apparatus, namely a notebook PC 100 having a base 102 which houses the keyboard, battery and electronics and a lid 104 housing a display screen. These portions 102 and 104 are coupled by a hinge 106, so that the lid can be closed against the base for compactness and protection of the screen, or opened up for viewing at a desired angle. Dotted arrows show the beginning of an opening movement.

Most apparatuses of this type carry one or more branded logo badges/labels and a novel badge 108 is shown in FIG. 1 which presents (for the sake of illustration) a roundel with the letter 'W' to identify the manufacturer. Viewed by the user as he or she prepares to open the lid 102, the 'W' is in the correct orientation.

Figure 2A:
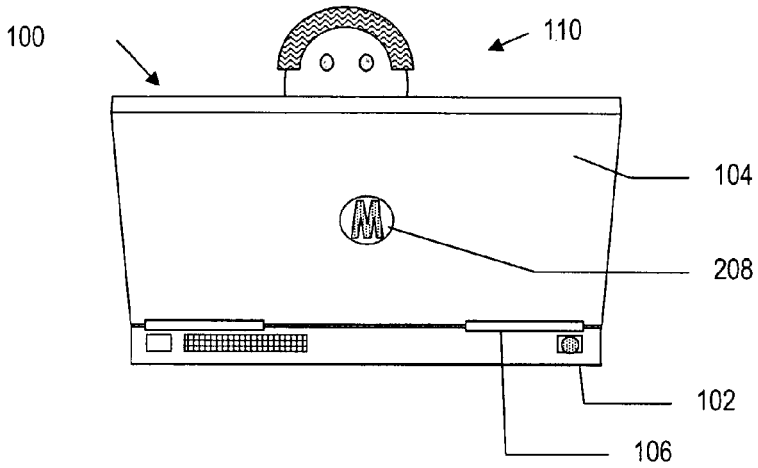
FIG. 2A (PRIOR ART)
FIG. 2A shows the appearance the apparatus would have in the open state, if it were to have a conventional badge.

FIG. 2A illustrates the scene when the PC 100 is in use, as viewed by another person sitting opposite the user 110 of the PC, assuming that the novel badge 108 were replaced by a conventional badge 208. Lid 104 has been opened to a near-vertical position for proper viewing of the screen, and badge 208 which presented the letter 'W' to the user 110 before the lid 104 was opened now presents an inverted (upside down) view of the 'W' logo to those sitting opposite the user 110. The appearance is thus more of a 'M'logo than a 'W'.

Figure 2B:
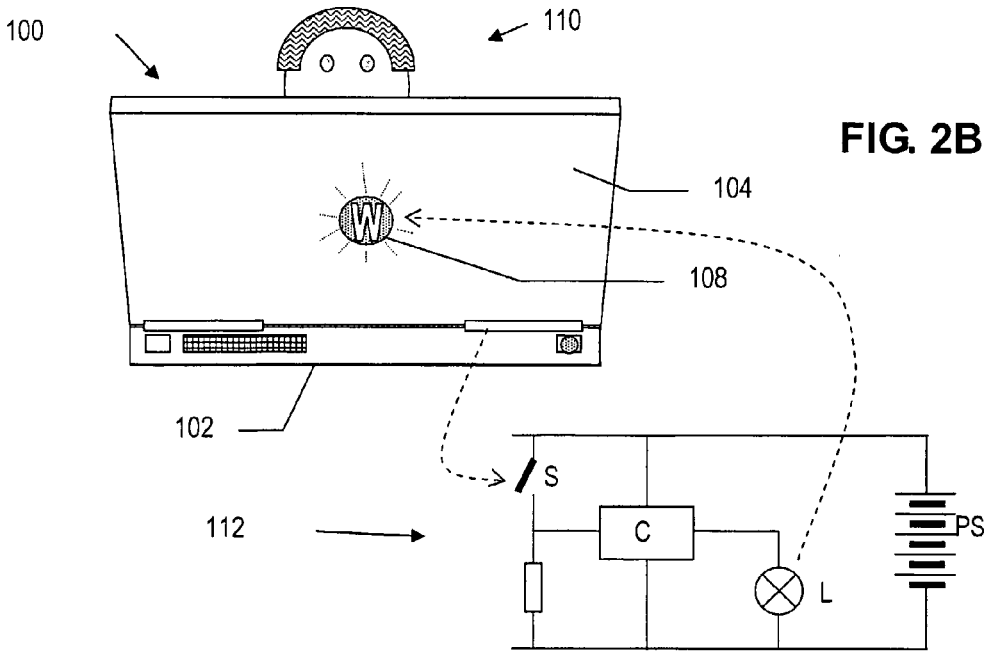
FIG. 2B shows the appearance of the apparatus embodying the invention in its open state, with internal electronic parts shown separately.

FIG. 2B then illustrates the same scene with the novel badge 108 in place. It will be seen that the novel badge 108, which in FIG. 1 presented a 'W' logo to the user, presents a 'W' logo to those viewing the badge, even after it has been inverted. This effect is created by the use of specialised inks and printing technologies, and a light source operating behind the badge within the appliance when it is in use. Connected to the physical illustration of the scene in FIG. 2 is a schematic diagram of electronic circuitry housed within the apparatus which controls the light source L housed behind the badge 108. PS represents a power supply which of course will be present in the form of the PC battery. Sensor S is operated mechanically by the action of opening the lid 104, and may be housed within the hinge, nearby, or associated with the catch which releases the lid for opening. Control circuit C, which may or may not include program-controlled functions operated through software, reads the state of the sensor and applies power to the light source L when the lid is in a predetermined range of orientations.

The light source L may be a point source, an array of point sources or an area source. It may include reflectors and/e or diffusing elements not shown. Filament bulbs, LEDs, electroluminescent and cold cathode fluorescent sources are all well known possibilities for use as the light source. Each has its own colour characteristics which should be taken into account in the design of the badge, for best effect.

The type of sensor S can of course vary widely, but most hinged of jointed apparatuses will already have means for sensing their open/closed condition, as this typically influences their mode of operation. For example, a telephone can be answered by opening the flip cover. A PC can be put into standby mode by closing its cover. If the desired range of orientations is not sufficiently indicated by the existing open/closed sensor, a separate sensor S can be provided purely to control the badge illumination. Other apparatuses such as a tablet PC may comprise a single body which nevertheless is designed to function in different specific orientations (portrait or landscape format, for example). If not already provided, it is a simple matter to include a tilt switch or other sensor specifically to control the illumination of the badge.

The notebook PC 100 presented and described above is only one example of an apparatus that can benefit from the novel badge arrangement. Other types of apparatus having "flip" or similar format include mobile phones, "tablet" computers handheld computers (personal digital assistants), digital cameras. A tablet or camera application may involve orientations that differ by 90 degrees instead of or in addition to the 180 degrees illustrated in the example above. Although simple hinges 106 are shown in the example, more complex joints are known, particularly those which allow a hinge and swivel movement. The invention can be adapted to these types of apparatus. It goes without saying also that some apparatus may have badges on more than one face, controlled together or independently.

FIGS. 3 to 6 illustrate in schematic cross section the construction of the badge 108, which is fitted within a panel of the apparatus housing (not shown in the drawings). In all of these drawings, the viewer is represented at V on the left side of the drawing, and the light source L, housed within the body of the apparatus behind the badge 108. The badge comprises a number of layers of differing composition, applied to a substrate, for which any clear plastic of suitable thickness can be used, including polycarbonate, polycarbonate blends, polyester, and PVC. This material must be transparent, but may be polished or matt and will commonly be either polished, matt or textured on the front side. The other layers may be applied for convenience by screen printing of different UV-curable and/or solvent-based inks, including so-called "special effect" inks, known already in the art. The cross section presented is schematic in that (i) the ink layers are shown for clarity with much greater thickness than would be expected in practice, and are shown separated from one another, again for clarity, while in practice they would be closely applied one on another.

Figure 3:
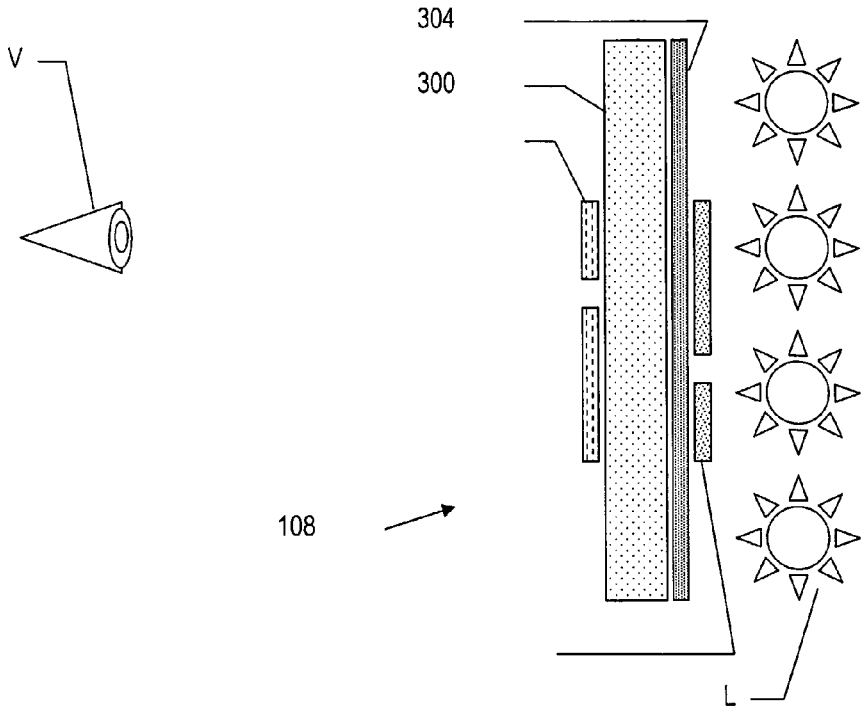
FIG. 3 is a more detailed schematic cross section of badge panel within in the apparatus of FIG. 1, according to a first embodiment of the invention.

In FIG. 3, the structural element of the badge 108 is substrate 300. On the front (obverse) surface of the substrate a first graphic layer 302 is printed to define the image visible to the user under ambient lighting when the light source L is off. The ink in layer 302 can be seen to be present in selected areas and not others, according to the desired graphic pattern. The pigment in layer 302 is a special effect pigment in a relatively low concentration, so that it is visible under ambient light but will allow passage of light from behind when the light source L is illuminated, and will effectively "disappear" altogether against the brighter illumination.

On the rear surface of the substrate 300 is a tinted masking layer 304 uniformly applied. Under ambient lighting, with light source L dark, masking layer 304 ensures that the first graphic image of layer 302 is seen against a uniform background, and anything behind layer 304 is effectively hidden. However, layer 304 is sufficiently transparent to allow light from light source L to shine through to the viewer V when the source is energised.

Behind masking layer 304 a second graphic layer 306 is printed (in selected areas), which defines the inverted pattern to be seen by viewer V when light source L is energised. The ink of layer 306 may be opaque or transparent in a colour appropriate to the light source, but contrasting with its background.

Figure 4:
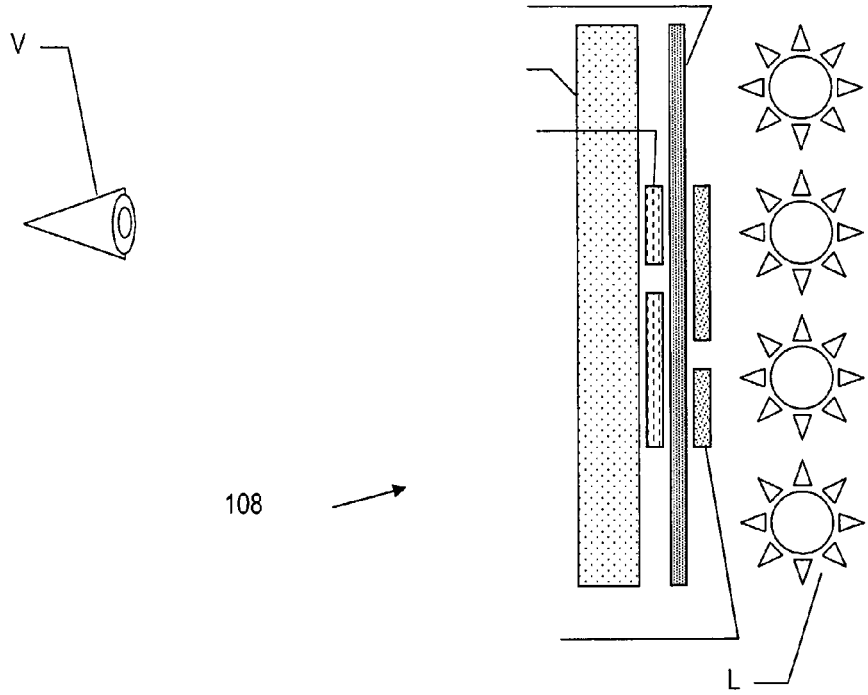
FIGS. 4 to 6 are schematic cross sections of badge arrangements in alternative embodiments of the invention.

FIG. 4 shows a construction very similar to that of FIG. 3, but with the first graphic layer 302 printed on the rear surface of the substrate (prior to printing the masking layer 304). This presents a different and popular "depth" effect, particularly when the front surface of the substrate 300 is polished. Again the first graphic disappears effectively to be replaced by the pattern of layer 306 when the light source is energised.

Additional colour layers may be provided at front or rear to tint the background, to heighten contrast and so forth. Most logos will have preferred colours according to a well-defined "house style" for the supplier of the apparatus, and the colours of inks and light sources can be selected to match or, if that is not possible, complement the preferred colours.

Figure 5:
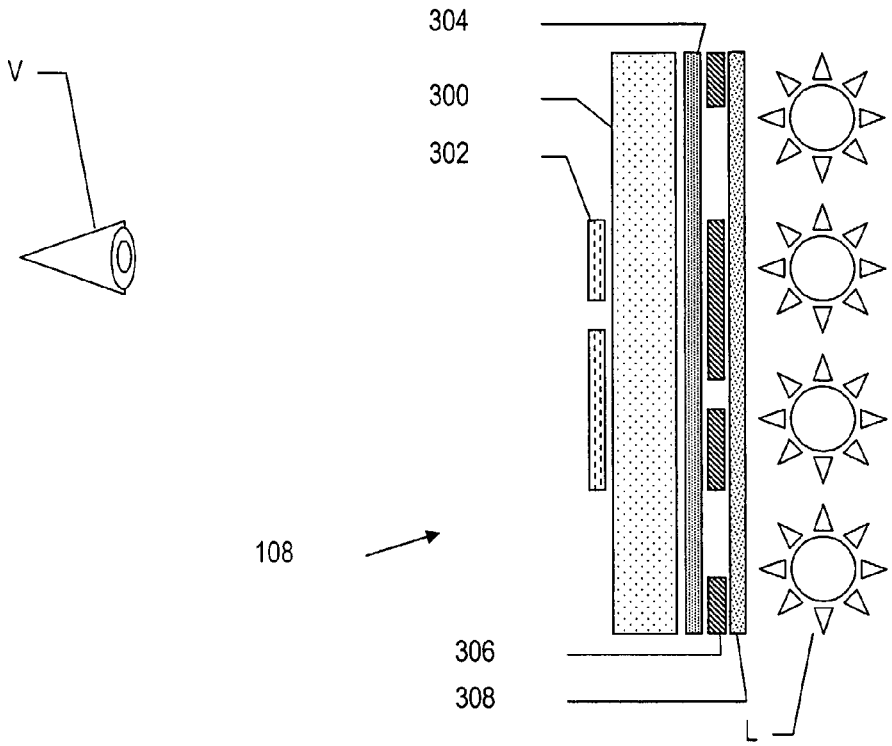

FIG. 5 shows a variation of the FIG. 3 example, which could equally be applied to the FIG. 4 example. As illustrated here, the second graphic layer 306 is printed in a strongly opaque ink, whereby the printed areas will appear dark against a luminous background, when light source L is energised. An additional coloured tint layer 308 is provided behind the second graphic layer 306, to filter the light from light source L and give the illuminated areas a desired hue. The pattern in second graphic layer 306 could of course be inverted to present the logo (letter 'W' or whatever) as an area of coloured light against a dark background, as seen in FIG. 2B.

As an alternative to light and dark areas, both layers 306 and 308 may have different colour tints, to define areas which are all illuminated, but have different colours. More than one layer may be provided with pattern, and the simple examples given here are illustrative only. However, since the back-lit image is competing with the image of the first graphic layer(s) which is visible under ambient light, images of bold contrasts are likely to be more successful than images with subtle shading.

Figure 6:
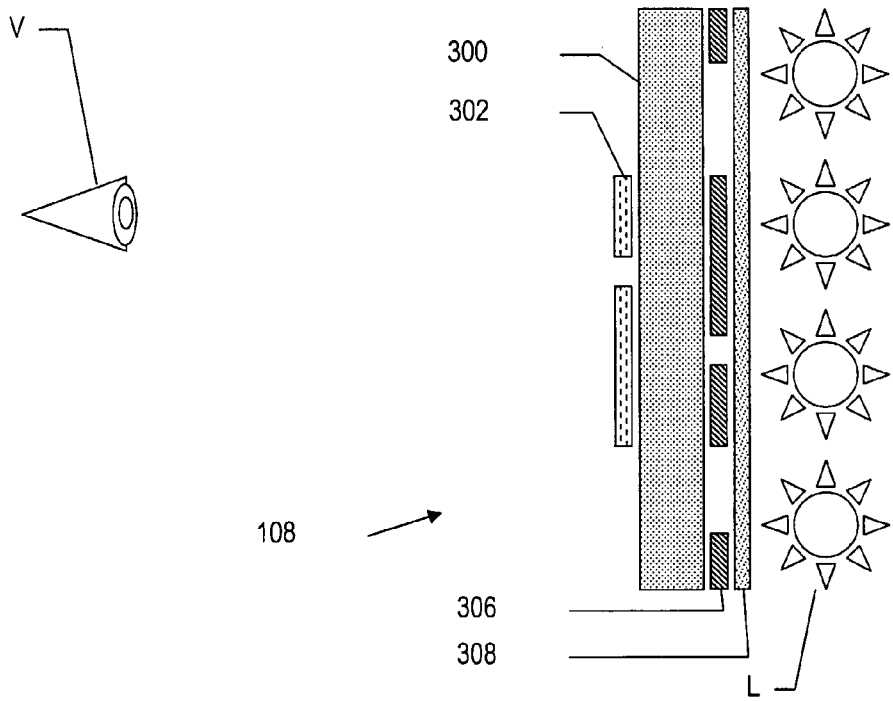

FIG. 6 illustrates another variation, starting from the example of FIG. 5, in which the tinted masking layer 304 is replaced by a general tint applied within the material of the substrate 300. This measure can also be applied in combination with a tinted layer 304, and indeed the different variations illustrated in FIGS. 3 to 6 and in the text can be mixed in ways not described here to produce yet further embodiments of the same general principle.

PROCESS EXAMPLES

For the manufacture of the badge 108 the following example processes can be applied, comprising three or four print sequences, depending on the embodiment. Different processes can be envisaged by the skilled reader.

Print Sequence #1—First Graphic Layer 302

The function of this layer is to define the graphics, which are to be viewed when the appliance is off or closed.

| | |
|---|---|
| Step 1 | 2.5% special effect pigment (for example Merck Iriodin, Merck Xirallic, Engelhard Dynacolor or Engelhard Lumina) was dispersed in a UV-curable screen printing transparent ink. For the transparent ink, Coates or Nor-cote supply suitable products. |
| Step 2 | This ink is printed using a 150 mesh in order to create a very thin layer of ink. This ink is a UV-curable ink. The graphics used to print this ink are used to define the logo to be seen without the light source. |
| Step 3 | The UV inks are cured as per manufacturer guidelines. |

Notes:

(i) Different pigment grades can be used which have different average particle size to give a different sparkle appearance and colour.

(ii) In this instance 2.5% pigment was used but it is possible to use a lower or higher percentage in the formulation to create different visual effects. The typical range will be 1% to 10% for best effect with the pigments mentioned.

(iii) "Iriodins are pearl lustre pigments based on natural mineral mica and are covered with a thin layer of metal oxide e.g. $TiO_2$ or $Fe_2O_3$. Through an interplay of transparency, refractive index, coating and multiple reflections you get a variety of colour effects which otherwise exist only nature, silver-white interference, gold and metallic lustre effects". (Quote from supplier's note)

(iv) "Xirallics are based on $Al_2O_3$ platelets coated with metal oxides. The $Al_2O_3$ platelets are produced synthetically using a new crystallisation process. Xirallic consists of coated aluminium oxide platelets that generates extremely colour intensive, crystal clear, high lustre transparent effects. Xirallic pigments show a lively glittering appearance and a brilliant sparkling effect". (Quote from supplier's note)

(v) Engelhard Lumina & Dynacolor are mica based, non-metallic effect pigments and exhibit similar behaviour to Merck Iriodins.

(vi) The following registered trade marks are acknowledged: Merck, Iriodin, Xirallic, Engelhard, Dynacolor.

Print Sequence #2—Masking Tint Layer 304

This layer must be opaque enough to stop the image from the third layer being visible but also transparent enough to allow these graphics to be visible when correct light source is applied.

| | |
|---|---|
| Step 1 | A semi-opaque ink is prepared using a mixture of standard UV-curable screen printing inks. This is a continuous layer of ink without any detailed graphics. A 120 mesh count is used to print this. |
| Step 2 | The UV inks are cured as per manufacturer guidelines. |

In this instance a metallic pigment was incorporated into the ink but this is not necessarily required to complete the effect.

Print Sequence #3—Second Graphic Layer 306

The function of this layer is to define graphics which are to be seen when light source is applied Depending on graphics & logo used the third print sequence will be different. One of the following methods 3A or 3B will be utilised:

Option 3A.

This applies to the examples of FIGS. 3 and 4.

| | |
|---|---|
| Step 1 | A custom made brightly coloured transparent screen printing ink is printed through a 120 mesh. Various transparent colours can be used for this purpose, for example, green, blue, red, and yellow. This is used to print the graphics in reverse. |
| Step 2 | The UV inks are cured as per manufacturer guidelines. |

Option 3B.

This applies to the examples of FIGS. 5 and 6.

| | |
|---|---|
| Step 1 | Standard opaque ink is printed through a 120 or 150 mesh to define the graphics in reverse. Various colours can be used to do this. |
| Step 2 | The UV inks are cured as per manufacturer guidelines. |

Print Sequence #4—Second Tinting Layer 308

This is only required if Option 3B has been used, and provides the background tint (colour) and enhance definition of graphics printed in sequence 3B which are to be seen when light source is applied.

| | |
|---|---|
| Step 1 | A custom made brightly coloured transparent screen printing ink is printed through a 120 mesh. Various transparent colours can be used for this purpose, for example, green, blue, red, and yellow. This is printed as a continuous layer of ink. |
| Step 2 | The UV inks are cured as per manufacturer guidelines. |

As various modifications have been discussed above besides the specific examples of FIGS. 3 to 6, the skilled reader will appreciate that the above process examples are amenable to further options and enhancements, and the badge can be assembled from discrete components as an alternative to using screen printing or any other manufacturing process. Direct writing processes (for example by laser) can also be used. Although concentrations of 2.5% pigment are mentioned in the examples, the best value will be found by experiment with the particular combination of materials and graphics desired. Typically somewhere in the range of 1%-10% concentration will be suitable. It is not essential to use UV-curable inks, and solvent-based inks may also be used.

The invention is not limited to displaying the same information in both orientations. In a mobile phone application, for example, the badge when lit may display the logo of the service provider rather than the handset manufacturer. The badge may also display a functional message, for example OPEN versus CLOSED, or symbols for on-hook and off-hook status of a telephone.

The invention claimed is:

1. An electronic apparatus having a body and provided on an outside part of the body with a badge comprising a multi-layer panel and a light source mounted within the part of the body to illuminate the badge from behind, wherein the apparatus body is articulated such that the orientation of the part of the body provided with the badge can be changed relative to the orientation of another part of the apparatus body, wherein the badge is constructed and mounted so as to present a predetermined graphic pattern in a first orientation relative to the body part provided with the badge when the light source is not activated and to present substantially the same graphic pattern in a second orientation relative to the body part provided with the badge when the light source is activated, wherein a masking layer having a tint is provided in the panel between a first graphic layer which defines the graphic pattern in the first orientation and a second graphic layer which defines the graphic pattern in the second orientation so that the graphic pattern is visible under ambient light in the first orientation while the graphic pattern is hidden until the light source is activated in the second orientation the apparatus further comprising means for sensing the orientation of the part of the body provided with the badge relative to the another part of the apparatus body and means for controlling the light source so as to activate it when the part of the body provided with the badge is in a predetermined range of orientations.

2. An electronic apparatus as claimed in claim l wherein the part of the body provided with the badge is a lid of the apparatus coupled by a pivoting joint to a larger body part.

3. An electronic apparatus as claimed in claim 2 wherein the lid carries a display panel on an inner face.

4. An electronic apparatus as claimed in claim 2 wherein the lid is arranged in normal use to open by pivoting upward about a transverse axis and to stand substantially upright in an open state of use, the control means and badge panel being constructed and oriented such that the graphic pattern is oriented correctly for viewing by a user prior to opening the lid. and, by activating the light source when the lid is opened, is oriented correctly for an observer other than the user in the open mode.

5. An electronic apparatus as claimed in claim 1 wherein the means for sensing the orientation of the part of the body is arranged to sense the orientation of the part of the body carrying the badge only relative to another part of the body.

6. An electronic apparatus as claimed in claim 1 wherein the means for sensing the orientation of the part of the body can sense orientation by reference to the force of gravity.

7. An electronic apparatus as claimed in claim l wherein the first graphic pattern is defined by a layer of special effect pigment which modifies light by interference effects so that the first graphic pattern to be visible under ambient light and allowing the second graphic pattern to he seen clearly through the first pattern when illuminated by the light source.

8. An electronic apparatus as claimed in claim 1 wherein the multi-layer panel of the badge comprises a first graphic layer which defines the graphic pattern in the first orientation and a second graphic layer which defines the graphic pattern in the second orientation, each graphic layer being formed by screen printing, and both are carried on a transparent substrate.

9. An electronic apparatus as claimed in claim 8 wherein the first and second graphic layers are carried on the same side of the substrate.

10. An electronic apparatus as claimed in claim 8 wherein the first and second graphic layers are carried on different sides of the substrate.

11. An electronic apparatus as claimed in claim 10 wherein a masking tint is incorporated in the substrate.

* * * * *